US010352070B2

(12) United States Patent
Margheritti et al.

(10) Patent No.: US 10,352,070 B2
(45) Date of Patent: Jul. 16, 2019

(54) DOOR LATCH WITH OPENING MEMORY FEATURE

(71) Applicant: Magna Closures S.p.A., Collesalvetti (IT)

(72) Inventors: Enrico Margheritti, Lucca (IT); Francesco Cumbo, Pisa (IT); Marco Taurasi, Livono (IT)

(73) Assignee: Magna Closures Inc., Newmarket (CA)

( * ) Notice: Subject to any disclaimer, the term of this patent is extended or adjusted under 35 U.S.C. 154(b) by 676 days.

(21) Appl. No.: 14/884,425

(22) Filed: Oct. 15, 2015

(65) Prior Publication Data

US 2016/0032626 A1 Feb. 4, 2016

Related U.S. Application Data

(63) Continuation of application No. 13/348,828, filed on Jan. 12, 2012, now Pat. No. 9,194,163.

(Continued)

(51) Int. Cl.
*E05B 81/16* (2014.01)
*E05B 77/32* (2014.01)

(Continued)

(52) U.S. Cl.
CPC ..... *E05B 81/16* (2013.01); *E05B 77/32* (2013.01); *E05B 79/20* (2013.01); *E05B 81/14* (2013.01);

(Continued)

(58) Field of Classification Search
CPC ..... Y10T 292/1047; Y10T 70/5889; Y10T 292/1076; Y10T 70/7102; Y10T 292/0978; Y10S 292/23; E05B 81/14
See application file for complete search history.

(56) References Cited

U.S. PATENT DOCUMENTS 5,074,603 A 12/1991 Brackman
5,865,481 A * 2/1999 Buschmann ..... E05B 77/06 292/169.11

(Continued)

FOREIGN PATENT DOCUMENTS

DE 102006032033 A1 3/2007
EP 1669526 A2 6/2006

(Continued)

OTHER PUBLICATIONS

European Search Report dated Sep. 25, 2015.

*Primary Examiner* — Mark A Williams
(74) *Attorney, Agent, or Firm* — Dickinson Wright PLLC

(57) ABSTRACT

A closure latch for a vehicle door is provided. The closure latch includes an emergency lock actuator to permit a person to lock the door in the event that the power lock actuator is unusable. The latch also includes an 'impatient passenger' feature, which permits the doors to be unlocked using the remote keyless-entry feature on the key fob even in a situation where an 'impatient passenger' had prematurely lifted the door handle of the vehicle. In some prior art latches, such an action by an 'impatient passenger' would prevent the drive motor on the latch from unlocking the latch, thereby necessitating the owner to press the unlock button on the key fob a second time. There is some overlap in the components that used for the 'impatient passenger' feature and the components used for the emergency lock actuator, thereby reducing cost and complexity of the latch.

20 Claims, 18 Drawing Sheets

Related U.S. Application Data

(60) Provisional application No. 61/432,831, filed on Jan. 14, 2011.

(51) Int. Cl.

| | |
|---|---|
| ***E05B 79/20*** | (2014.01) |
| ***E05B 81/90*** | (2014.01) |
| ***E05B 81/14*** | (2014.01) |
| ***E05C 3/12*** | (2006.01) |
| *E05B 85/26* | (2014.01) |

(52) U.S. Cl.

CPC ..... *E05B 81/15* (2013.01); *E05B 81/90* (2013.01); *E05C 3/124* (2013.01); *E05B 85/26* (2013.01); *Y10T 292/108* (2015.04)

(56) References Cited

U.S. PATENT DOCUMENTS

| | | | | |
|---|---|---|---|---|
| 6,464,284 | B2 | 10/2002 | Neubrand | |
| 6,932,393 | B2 * | 8/2005 | Erices | E05B 81/06 292/216 |
| 7,434,853 | B2 * | 10/2008 | Yamamoto | E05B 81/14 292/201 |
| 2001/0024040 | A1 * | 9/2001 | Spurr | E05B 85/243 292/216 |
| 2001/0048227 | A1 * | 12/2001 | Kachouh | E05B 81/14 292/216 |
| 2003/0164616 | A1 * | 9/2003 | Belmond | E05B 77/12 292/201 |
| 2005/0212302 | A1 * | 9/2005 | Fisher | E05B 81/14 292/216 |
| 2005/0218661 | A1 * | 10/2005 | Brose | E05B 81/06 292/216 |
| 2006/0028029 | A1 | 2/2006 | Spurr | |
| 2009/0134638 | A1 * | 5/2009 | Kutschat | E05B 85/247 292/216 |
| 2009/0322104 | A1 * | 12/2009 | Nam | E05B 85/243 292/216 |
| 2011/0187132 | A1 * | 8/2011 | Scholz | E05B 81/20 292/226 |
| 2011/0204660 | A1 * | 8/2011 | Cumbo | E05B 85/243 292/217 |
| 2016/0090759 | A1 * | 3/2016 | Rosales | E05B 79/22 292/220 |

FOREIGN PATENT DOCUMENTS

| | | | |
|---|---|---|---|
| GB | 2155535 | A | 9/1985 |
| WO | 2008144904 | A1 | 12/2008 |
| WO | 2009143997 | A1 | 12/2009 |

* cited by examiner

DOOR LATCH WITH OPENING MEMORY FEATURE

CROSS-REFERENCE TO RELATED APPLICATIONS

This application is a continuation of U.S. application Ser. No. 13/348,828 filed Jan. 12, 2012, which claims the benefit of U.S. Provisional Application No. 61/432,831 filed Jan. 14, 2011. The entire disclosure of each of the above applications is incorporated herein by reference.

FIELD OF THE INVENTION

The present invention relates to a closure latch for a vehicle door, and more particularly to a closure latch with a ratchet and a mechanical linkage for operatively connecting a door handle to the ratchet.

BACKGROUND

Vehicle door latches typically include as a minimum a ratchet that holds a striker, and a pawl that releasably holds the ratchet closed. When a person wishes to open a vehicle door, the person pulls a door handle to move the pawl out of the way of the ratchet, and the person typically opens the door at the same time, so as the pull the striker from the ratchet bringing the ratchet to an open position. Additionally, vehicle manufacturers sometimes design the vehicle door so that the seal on the door (i.e., the door seal) urges the door open once the door handle is pulled, so as to assist in pulling the striker from the ratchet. As the vehicle ages however, or in certain conditions, such as very cold weather, the door seal force typically decreases. In a situation where there is a delay between when the door handle is pulled and when the door is opened, the pawl can inadvertently wind up in a position whereat it obstructs the ratchet from releasing the striker. In such a situation the person opening the door must pull on the door handle a second time and then open the door immediately, which can be inconvenient.

It would be beneficial to provide a closure latch that permits a delay between when the door handle is pulled and when the door itself is opened.

SUMMARY

One aspect provides a vehicle latch that includes a ratchet, a pawl, a memory lever and a release lever. During opening of the latch and door, the memory lever is movable to a pawl blocking position to prevent the pawl from obstructing the ratchet from releasing the striker in the event of a delay between when a door handle is pulled and when the door is opened.

In a particular embodiment, the ratchet is movable between an open position wherein the ratchet is positioned to receive a striker and a closed position wherein the ratchet is positioned to retain the striker. The ratchet is biased towards the open position. The pawl is movable between a ratchet locking position wherein the pawl is positioned to hold the ratchet in the closed position and a ratchet release position wherein the pawl permits the movement of the ratchet out of the closed position. The pawl is biased towards the ratchet locking position. The memory lever is movable between a pawl blocking position in which the memory lever prevents movement of the pawl to the ratchet locking position and a pawl unblocking position wherein the memory lever permits movement of the pawl to the ratchet locking position. The memory lever is biased towards the pawl blocking position. The release lever is movable between a first position in which the release lever prevents movement of the memory lever to the pawl blocking position and a second position in which the release lever permits movement of the memory lever to the pawl blocking position and permits movement of the pawl to the ratchet release position. The release lever is biased towards the first position. The release lever is operatively connectable to at least one of an inside door handle and an outside door handle for movement to the second position. In an event in which the release lever is moved to the second position and the ratchet is restrained from movement to the open position, movement of the memory lever to the pawl blocking position drives the pawl to the ratchet release position.

BRIEF DESCRIPTION OF THE DRAWINGS

The present invention will now be described by way of example only with reference to the attached drawings, in which.

DETAILED DESCRIPTION

Figure 1:
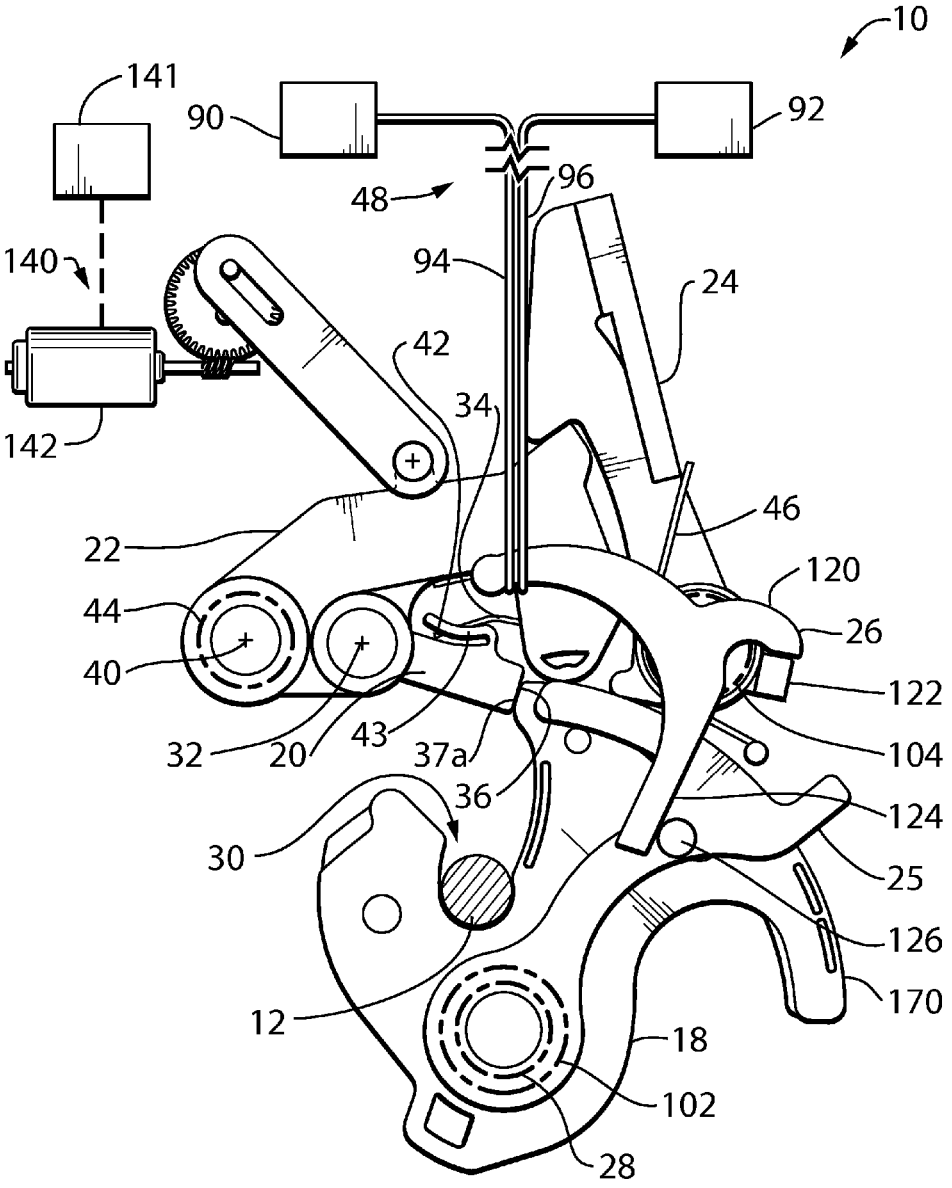
FIGS. 1-10 are plan views of a closure latch for a vehicle door in accordance with an embodiment, in a range of positions.

Reference is made to FIG. 1, which shows a vehicle latch 10, for receiving and holding a striker 12. The vehicle latch 10 may be mounted on a vehicle closure panel such as a vehicle door (not shown), while the striker 12 may be mounted on a vehicle body (not shown). Alternatively, the vehicle latch 10 may be mounted on the vehicle body and the striker 12 may be mounted on the vehicle closure panel (e.g. vehicle door).

The latch 10 includes a primary ratchet 18, a primary pawl 20, an auxiliary ratchet 22, an auxiliary pawl 24, a memory lever 25 and a release lever 26. The primary ratchet 18 is pivotally mounted to a latch housing (not shown) on the vehicle door for pivotal movement between an open position (FIG. 7) wherein the primary ratchet 18 is positioned to receive or release the striker 12, and a closed position (FIG. 1) wherein the primary ratchet 18 is positioned to retain the striker 12. The primary ratchet 18 is biased towards the open position by a ratchet biasing member 28, which may be, for example, a torsion spring.

The primary ratchet 18 includes a slot 30 that is configured to hold the striker 12 when the primary ratchet 18 is in the closed position (FIG. 1), thereby preventing the striker 12 from being withdrawn from the primary ratchet 18. The slot 30 is also configured to cooperate with the striker 12 such that when the striker 12 is initially received in the slot 30, the striker 12 urges the rotation of the primary ratchet 18 towards its closed position (FIG. 1).

The primary pawl 20 is pivotally mounted to the auxiliary ratchet 22 for movement about a primary pawl pivot axis shown at 32. The primary pawl 20 is movable between a ratchet locking position (FIG. 1) wherein the primary pawl 32 holds the primary ratchet 18 in the closed position (FIG. 1), and a ratchet release position (FIG. 5) wherein the primary pawl 20 permits the movement of the primary ratchet 18 out of the closed position. The primary pawl 20 is biased towards the ratchet locking position (FIG. 1) by a primary pawl biasing member 34, which may be, for example, a torsion spring.

Figure 10:
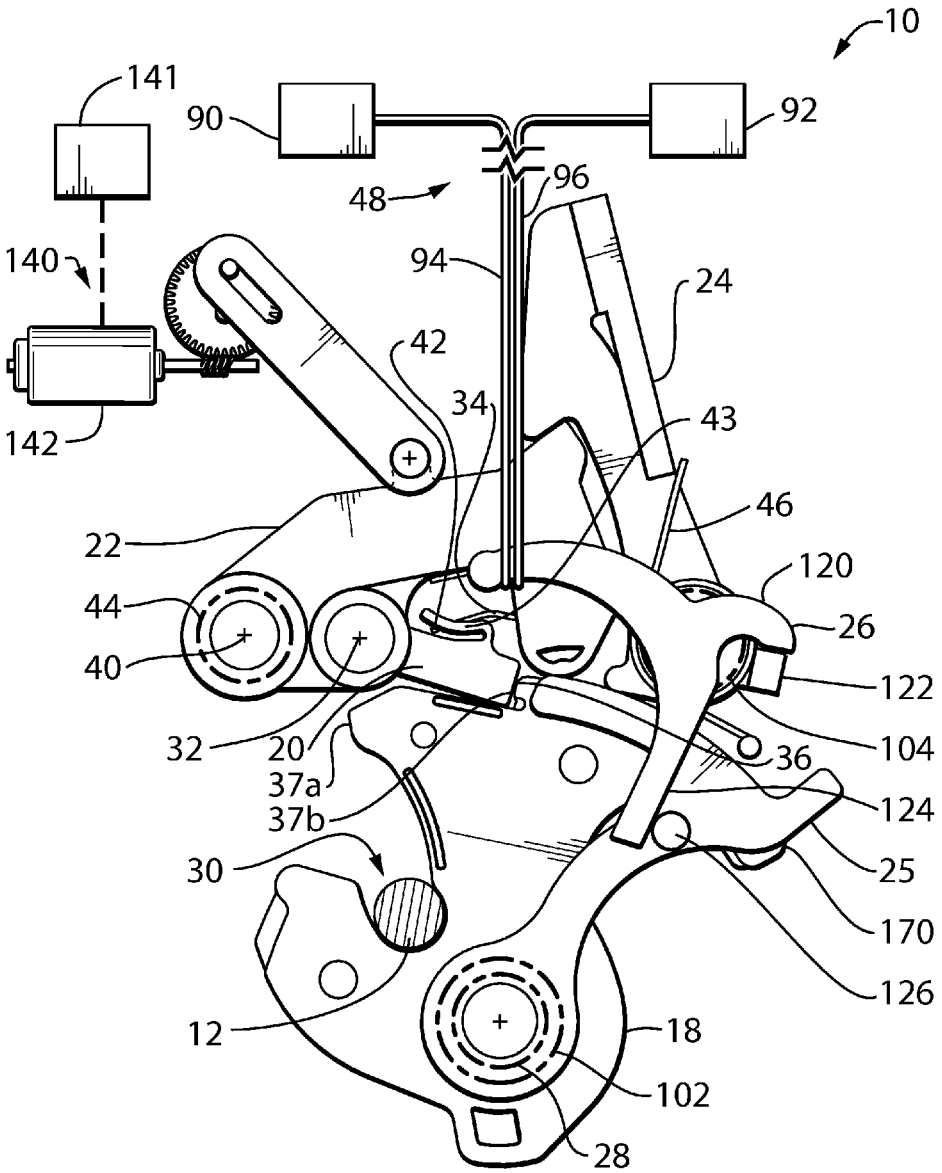

The primary pawl 20 includes a primary pawl locking surface 36 which engages either a primary ratchet locking surface 37*a* to lock the primary ratchet 18 in the closed position (FIG. 1) or a second ratchet locking surface 37*b* to lock the primary ratchet 18 in an intermediate closed position (FIG. 10).

Figure 8:
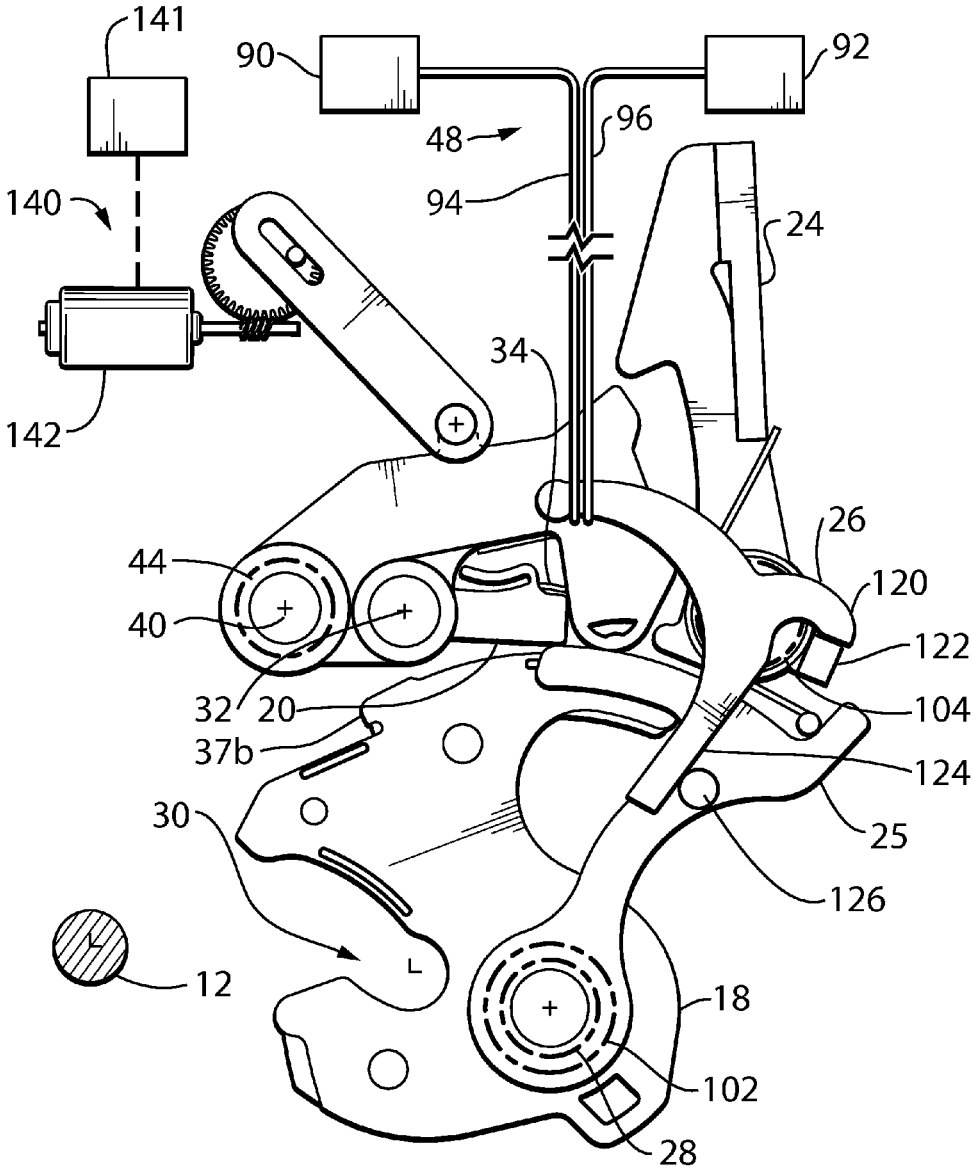

The auxiliary ratchet 22 is pivotally mounted to the latch housing (not shown) about an auxiliary ratchet pivot axis 40 for movement between a pawl disabling position (FIG. 5) wherein the auxiliary ratchet 22 positions the primary pawl 20 in the ratchet release position, and a pawl enabling position wherein the auxiliary ratchet 22 is reset, as shown in FIG. 8 and as described in greater detail below. As seen in FIG. 1, a primary pawl retainer member 42 on the auxiliary ratchet 22 cooperates with a corresponding retainer member 43 on the primary pawl 20 to limit the rotation of the primary pawl 20 relative to the auxiliary ratchet 22. Because the position of the auxiliary ratchet 22 thus controls at least to some extent the position of the primary pawl 20, the auxiliary ratchet 22 may be said to be operatively connected to the primary pawl 20.

The auxiliary ratchet 22 may be biased towards the pawl disabling position by an auxiliary ratchet biasing member 44, which may be, for example, a torsion spring.

The auxiliary pawl 24 is pivotally mounted to the latch housing (not shown) about an auxiliary pawl pivot axis for movement between an auxiliary ratchet locking position (FIG. 1) wherein the auxiliary pawl 24 is positioned to hold the auxiliary ratchet 22 in the pawl enabling position, and an auxiliary ratchet release position (FIG. 2) wherein the auxiliary pawl 24 is positioned to permit the movement of the auxiliary ratchet 22 out of the pawl enabling position to its pawl disabling position.

The auxiliary pawl 24 is biased towards the auxiliary ratchet locking position by an auxiliary pawl biasing member 46, which may be, for example, a torsion spring.

The memory lever 25 is pivotally mounted to the latch housing (not shown), optionally about the same axis as the primary ratchet 18, for movement between a pawl blocking position (FIG. 6) in which the memory lever 25 prevents movement of the primary pawl 20 to the ratchet locking position and a pawl unblocking position (FIG. 9) wherein the memory lever 25 permits movement of the primary pawl 20 to the ratchet locking position. The memory lever 25 is biased towards the pawl blocking position by a memory lever biasing member 102, which may be, for example, a torsion spring.

The release lever 26 includes a first arm 120 which engages a corresponding arm 122 on the auxiliary pawl 24. The release lever 26 further includes a second arm 124 that engages a pin 126 on the memory lever 25. The release lever 26 is pivotally movable between a first position (FIG. 9) in which the release lever 26 drives the auxiliary pawl 24 to the auxiliary ratchet release position and in which the release lever 26 permits the memory lever 25 to move to the pawl blocking position, and a second position (FIG. 6) in which the release lever 26 permits movement of the auxiliary pawl 24 to the auxiliary ratchet locking position and in which the release lever 26 prevents movement of the memory lever 25 to the pawl blocking position.

The release lever 26 is biased towards the second position by a release lever biasing member 104, which may be, for example, a torsion spring. The release lever biasing member 104 is configured to rotate the release lever 26 with sufficient force to overcome the force with which the memory lever 25 is rotated towards the pawl blocking position. It will be noted that in the embodiment shown in FIGS. 1-10, the memory lever 25 is engaged with the release lever 26 and so the memory lever biasing member 102 assists in urging the release lever 26 towards its first position.

A mechanical linkage 48 operatively connects one or both of an inside door handle 90 and an outside door handle 92 to the primary pawl 20 for moving the pawl to the ratchet release position (FIG. 5) and for moving the memory lever 25 to the pawl blocking position. The mechanical linkage 48 may have any suitable structure. For example, the mechanical linkage 48 may include cables 94 and 96 that connect between the door handles 90 and 92 respectively and the release lever 26. In an alternative embodiment the cables 94 and 96 may connect between the door handles 90 and 92 and another lever (not shown), which actuates the release lever 26.

The mechanical linkage 48 may be the primary means of operatively connecting the inside and outside door handles 90 and 92 to the release lever 26. Alternatively the mechanical linkage 48 may be a backup means for use in the event of failure of a primary means that is electrically powered. Alternatively, it is possible that the mechanical linkage 48 can be omitted and that an electrically powered means (e.g. using a bidirectional electric motor) is the only means for operatively connecting the inside and outside door handles 90 and 92 to the release lever 26.

Figure 2:
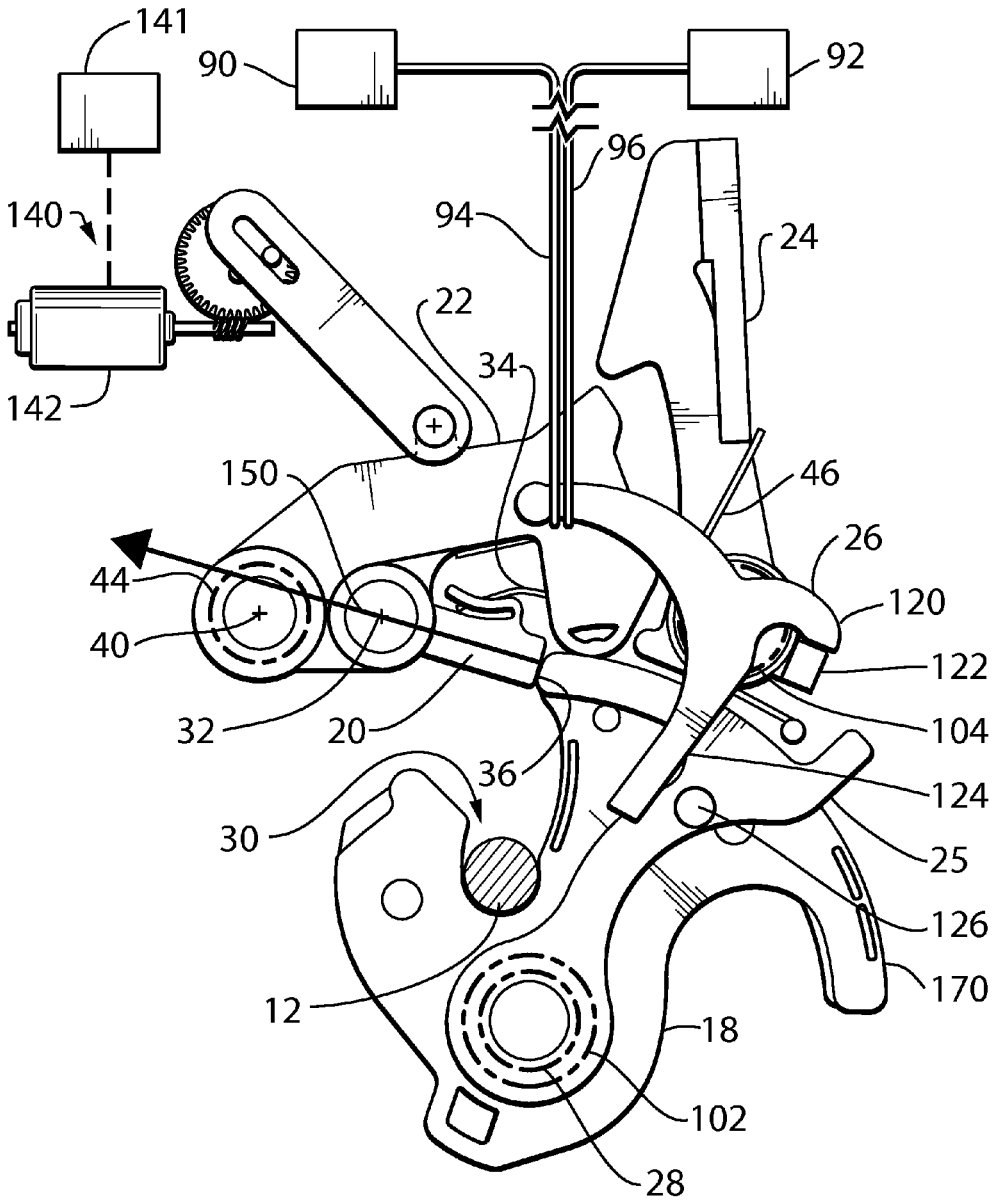
Figure 3:
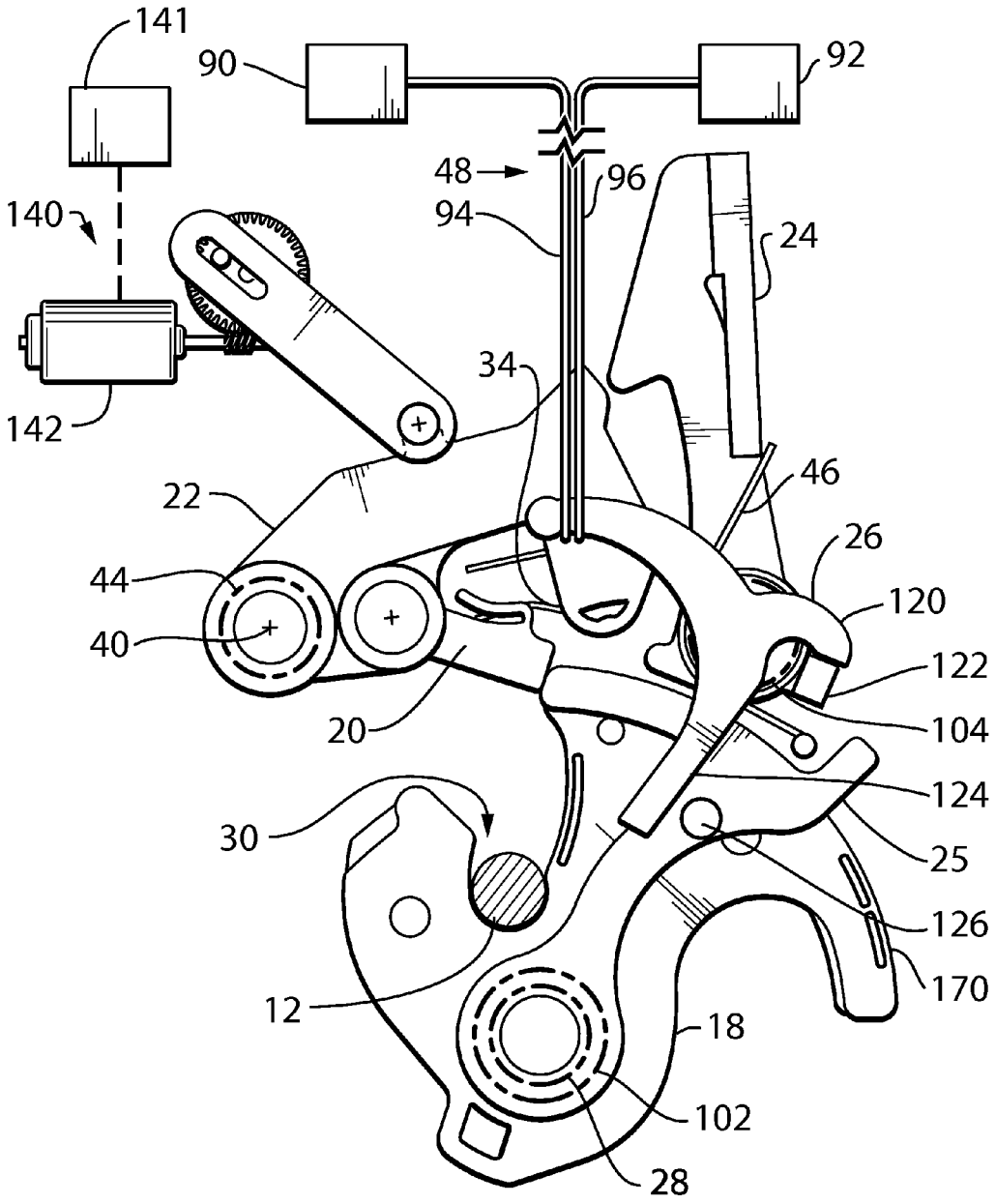

Operation of the latch 10 is described as follows. In the position shown in FIG. 1, the latch 10 is closed. Actuation of the inside or outside door handle 90 or 92 causes movement of the release lever 26 from the first position (FIG. 1) to the second position (FIG. 2). Movement of the release lever 26 to the second position drives movement of the auxiliary pawl 24 to the auxiliary ratchet release position (FIG. 2). Movement of the auxiliary pawl 24 to the auxiliary ratchet release position permits movement of the auxiliary ratchet 22 to the pawl disabling position (FIGS. 3-5), which brings the primary pawl 20 to the ratchet release position (FIGS. 3-5).

Figure 5:
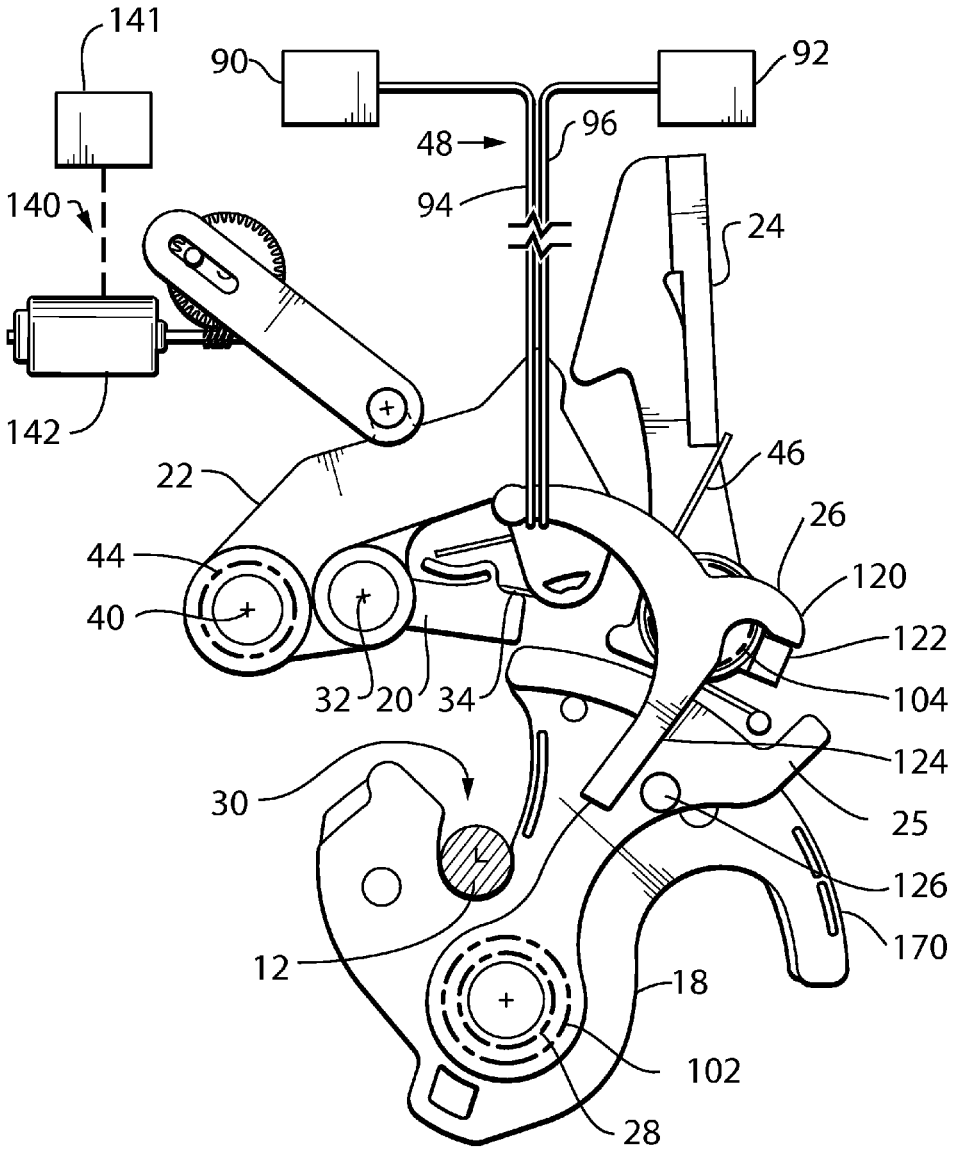
Figure 6:
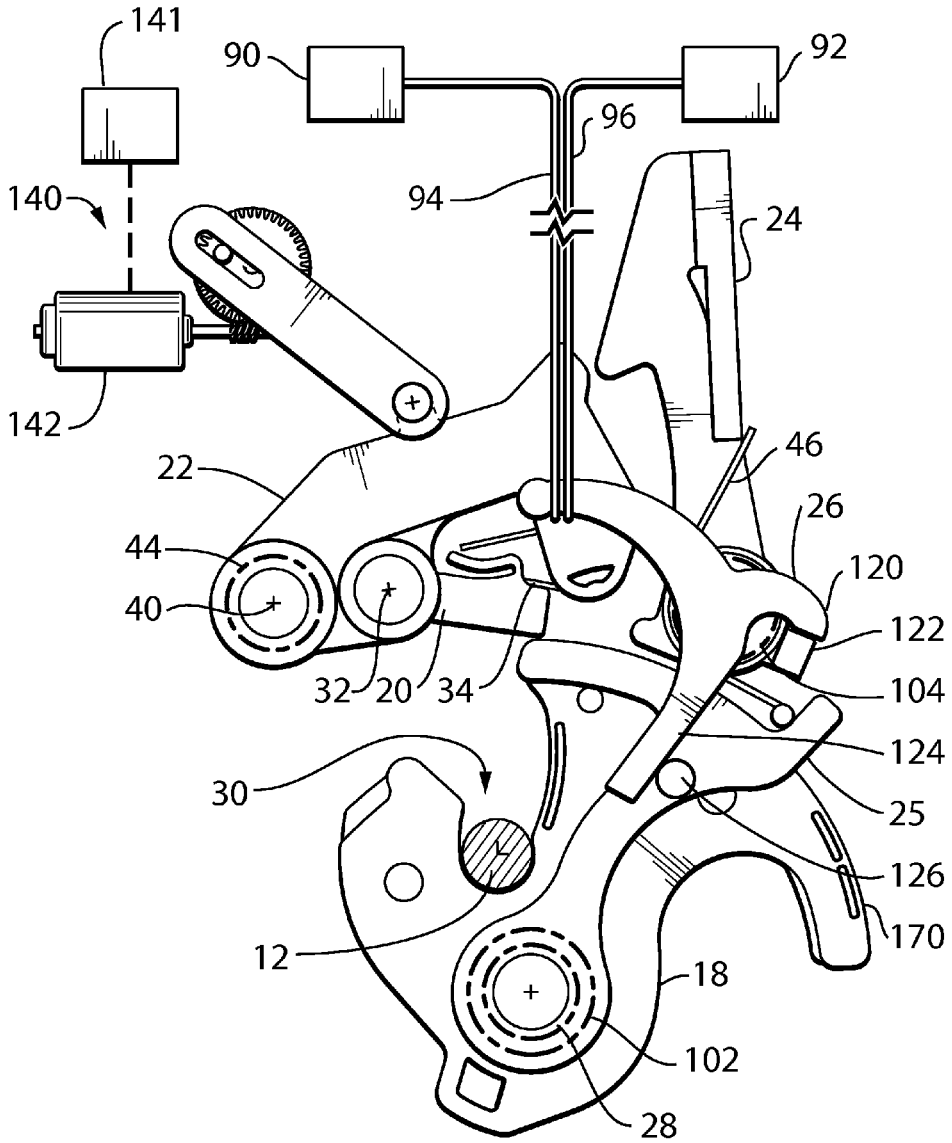

Movement of the release lever 26 to the second position (FIG. 2) additionally permits movement of the memory lever 25 from the pawl unblocking position (FIG. 1) towards the pawl blocking position (FIG. 6). Initially, prior to movement of the primary pawl 20 out of the way, the memory lever 25 comes to rest in abutment with the primary pawl 20 as shown in FIG. 2. The force of the memory lever biasing member 102 causes the memory lever 25 to exert a force F1 on the primary pawl 20, which in acts in a direction shown at 150. The force F1 acts generally through the axis of rotation 32 of the primary pawl 20 and therefore does not exert a large moment on the primary pawl 20 itself. However, the force causes the primary pawl 20 to generate a counterclockwise moment on the auxiliary ratchet 22 about the auxiliary ratchet rotation axis 40, which drives the auxiliary ratchet 22 towards its pawl disabling position. As the auxiliary ratchet 22 moves upwards towards the pawl disabling position it brings the primary pawl 20 upwards with it. Once the primary pawl 20 moves upwards sufficiently (i.e., to the position shown in FIG. 4), the memory lever 25 rotates to its pawl blocking position (as shown by the progression of movement of the memory lever 25 in FIGS. 5 and 6).

Figure 4:
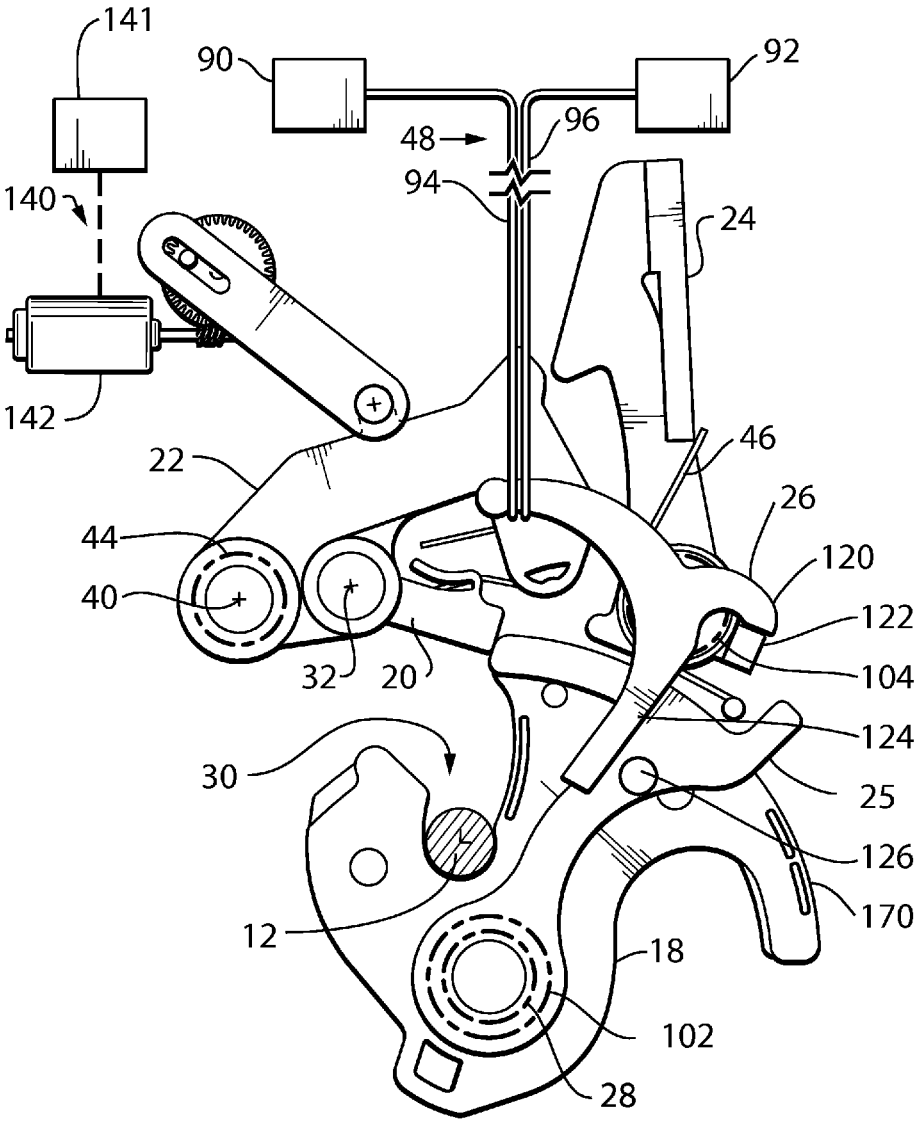

It will be noted that FIG. 5 differs from FIG. 4 in that FIG. 5 shows the primary pawl 20 having moved upward on its own (i.e., without being pulled upwards by the auxiliary ratchet 22). This is due to momentum in the primary pawl 20 that drives it upwards slightly after the auxiliary ratchet 22 has stopped moving. Without the memory lever 25 moving in to block it, the primary pawl 20 would return under spring pressure back to a position where it could inadvertently engage the primary or secondary surfaces 37*a* or 37*b* on the ratchet 18 and thus prevent the opening of the ratchet 18, if the ratchet 18 itself had not opened quickly enough. A situation in which the ratchet 18 might not open quickly enough would be where the door seal force is not sufficient, due for example, to cold weather or to aging.

Figure 7:
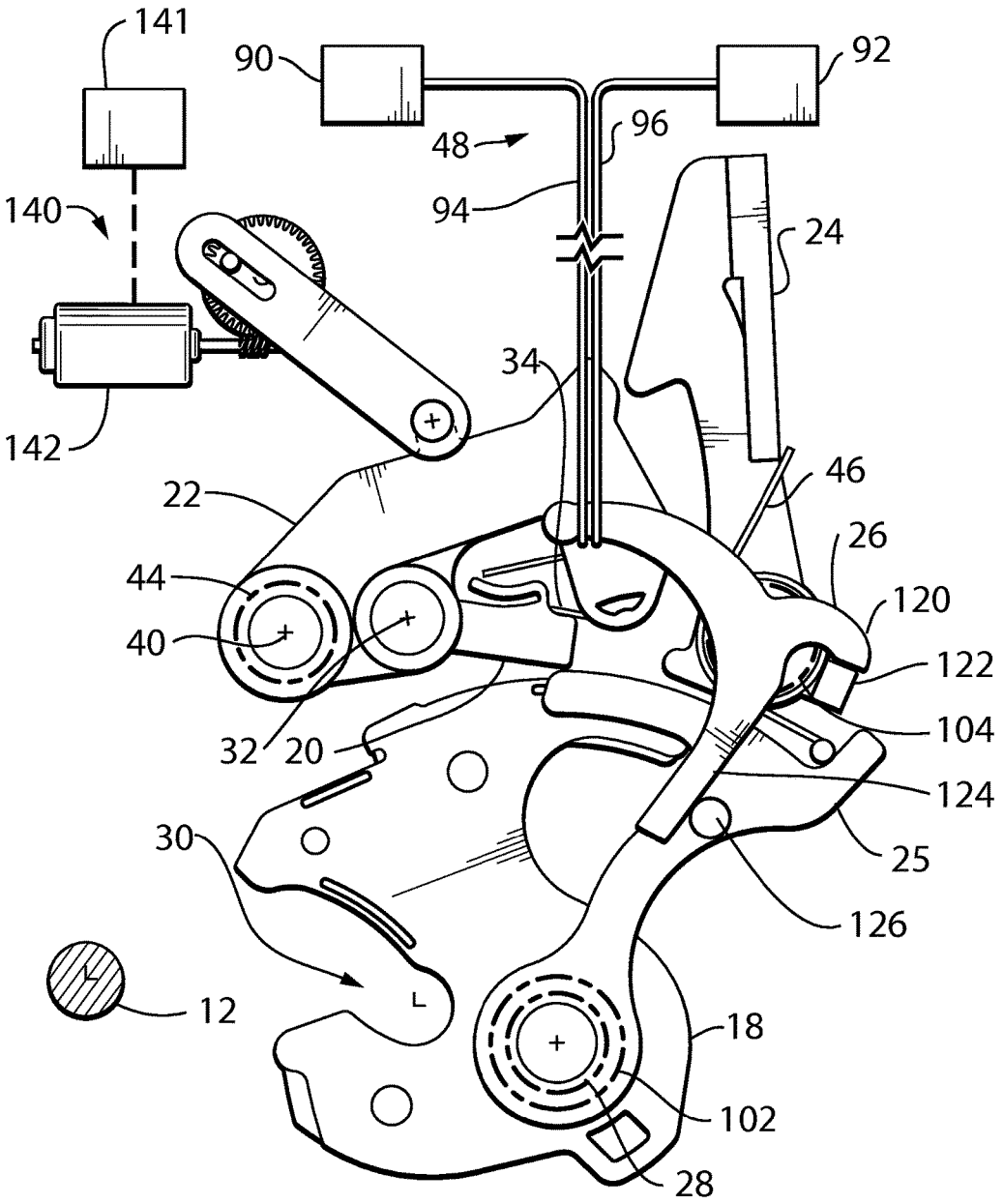
Figure 9:
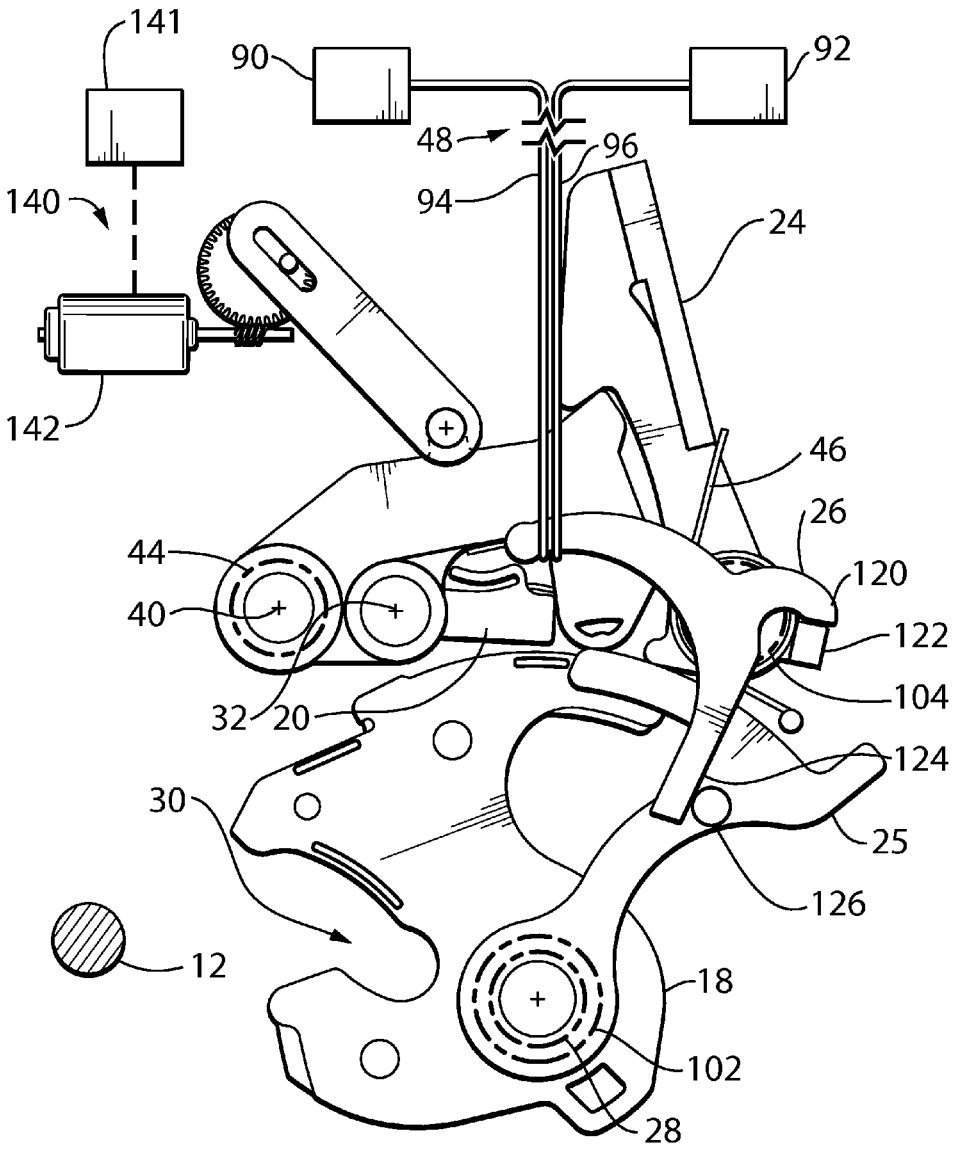

If the person opens the vehicle door while pulling the door handle 90 or 92, the striker 12 is pulled from the primary ratchet 18 and the primary ratchet 18 moves to its open position as shown in FIG. 7. At this point, a drive mechanism 140 under the control of a controller 141 will attempt to move the latch 10 to a reset position after a selected period of time has passed. Initially, the drive mechanism 140 (including, for example, a motor 142) moves the auxiliary ratchet 22 to the pawl enabling position (FIG. 8). If the person has still not released the door handle 90 or 92 at this point, the release lever 26 remains in the second position, and therefore the memory lever 25 remains in the pawl blocking position, and thus the primary pawl 20 remains blocked by it, as shown in FIG. 8. Furthermore, the release lever 26 prevents the auxiliary pawl 24 from moving to the auxiliary ratchet locking position. When the person does release the door handle 90 or 92, the release lever biasing member 104 drives the release lever 26 to its first position, which in turn drives the memory lever 25 to its pawl unblocking position at which point the primary pawl 20 comes to rest against the radial edge 170 of the primary ratchet 18, as shown in FIG. 9. In the position shown in FIG. 9, the latch 10 may be said to be in the reset position.

If, however, the person did not open the door after pulling the door handle 90 or 92, and if the door seal force was not sufficient to pull the striker 12 from the primary ratchet 18, then the drive mechanism (not shown) would attempt to move the latch 10 to the reset position while the primary ratchet 18 was not yet open. In such a situation, if the person continued to hold the door handle 90 or 92 open, the release lever 26 would remain in the second position, and the memory lever 25 would remain in the pawl blocking position (FIG. 8). As a result, when the drive mechanism would reset the auxiliary ratchet 22 to the pawl enabling position, the primary pawl 20 would rest against the memory lever 25. As a result, when the person finally opened the door (while continuing to hold the door handle 90 or 92 open at least for an initial portion of the door travel), the primary pawl 20 would be prevented from engaging the first or second ratchet locking surfaces 37*a* (FIG. 1) and 37*b* (FIG. 8), and so the striker 12 would be pulled from the primary ratchet 18 bringing the primary ratchet 18 to its open position. At this point, if the person released the door handle 90 or 92, the release lever biasing member 104 would drive the release lever 26 to its first position, which in turn would drive the memory lever 25 to its pawl unblocking position at which point the primary pawl 20 would come to rest against the radial edge 170 of the primary ratchet 18, as shown in FIG. 9.

With the latch 10 in the reset position in FIG. 9, closing the door would bring the striker 12 into the slot 30 of the primary ratchet 18 and would drive the primary ratchet 18 towards its closed position. If the door was not closed with enough force, the primary ratchet 18 may only be driven to a partially closed position in which the primary pawl 20 would engage the second ratchet locking surface 37*b*. If the door was closed with sufficient force, the primary ratchet 18 would be driven to a closed position in which the primary pawl 20 engages the primary ratchet locking surface 37*a* and holds the primary ratchet 18 in the closed position (FIG. 1).

Figure 11:
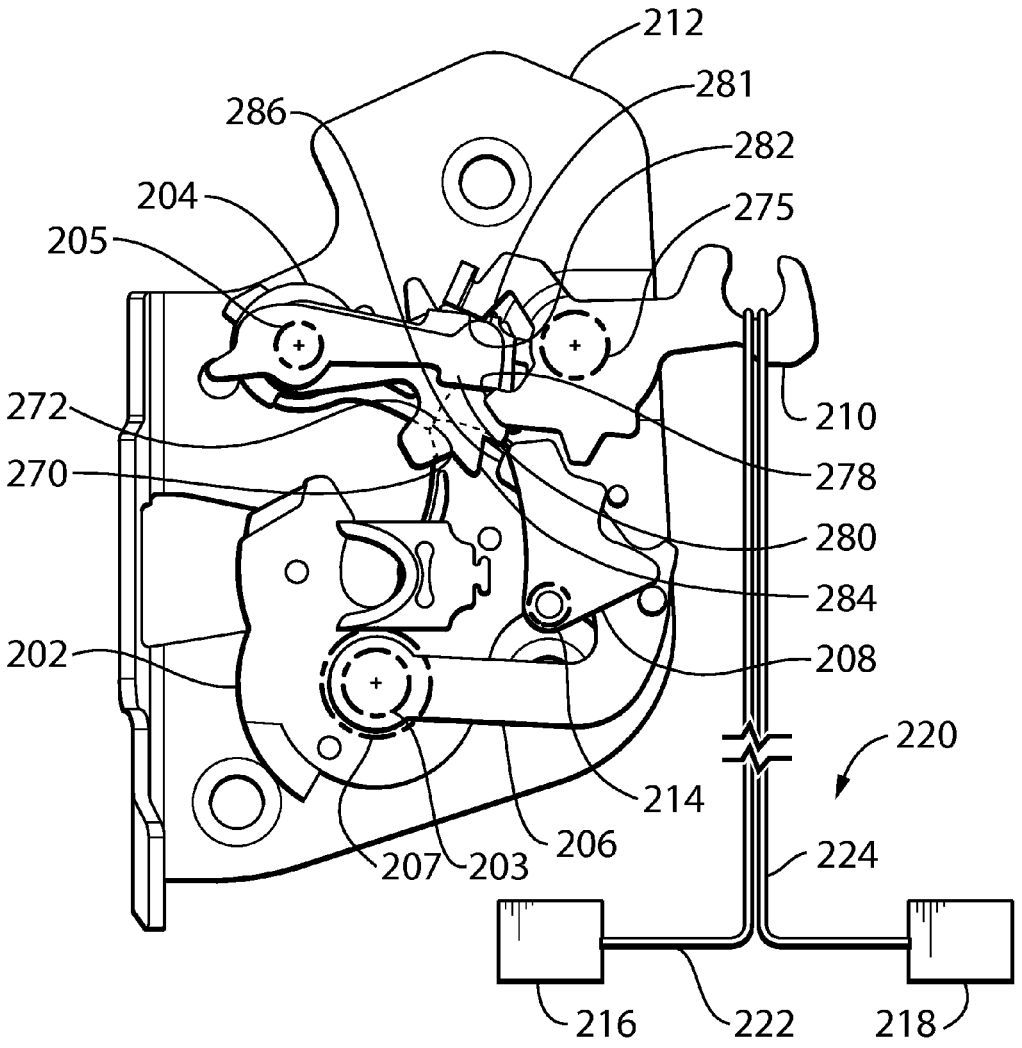
FIGS. 11-17 are plan views of a closure latch for a vehicle door in accordance with another embodiment, in a range of positions.
Figure 11A:
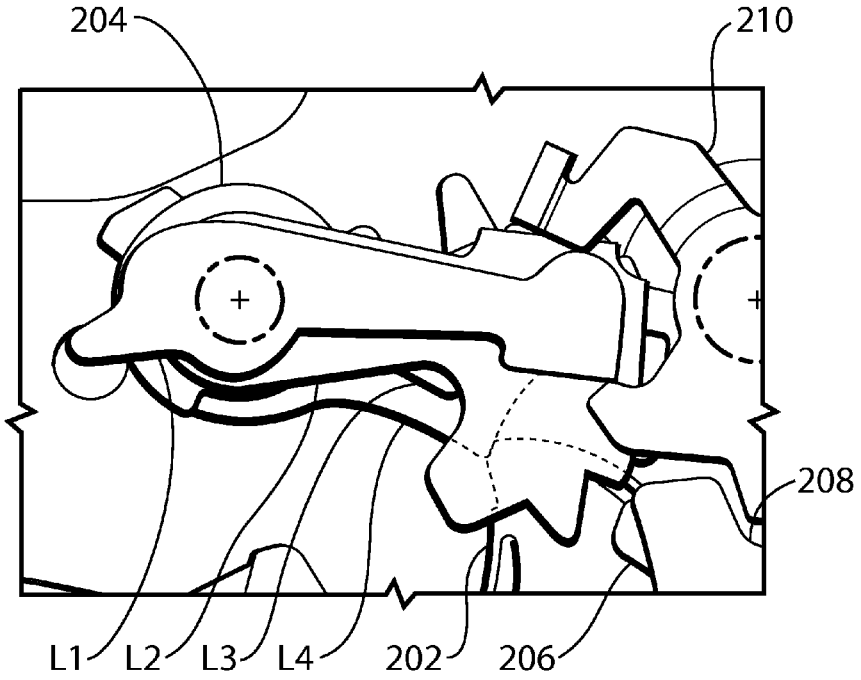

Reference is made to FIGS. 11 and 11*a*, which shows a latch 200 in accordance with another embodiment. The latch 200 does not include an auxiliary ratchet and an auxiliary pawl. It includes a ratchet 202, a pawl 204, a memory lever 206, a block lever 208 and a release lever 210. The ratchet 202 may be similar to the ratchet 18 (FIG. 1) and is biased towards the open position by a 10 ratchet biasing member 203.

The pawl 204 may be similar to the pawl 20 (FIG. 1) and is biased towards the ratchet locking position by a pawl biasing member 205, however the pawl 204 is pivotally mounted to the latch housing shown at 212. The pawl 204 includes several features which are on different planes and are configured for engagement with several other latch components. For example, the pawl 204 includes a ratchet/pawl locking surface 270 configured to engage the first or second ratchet/pawl locking surfaces 272 or 274 (FIG. 17) on the ratchet 202 to hold the ratchet 202 in the closed position.

Figure 16:
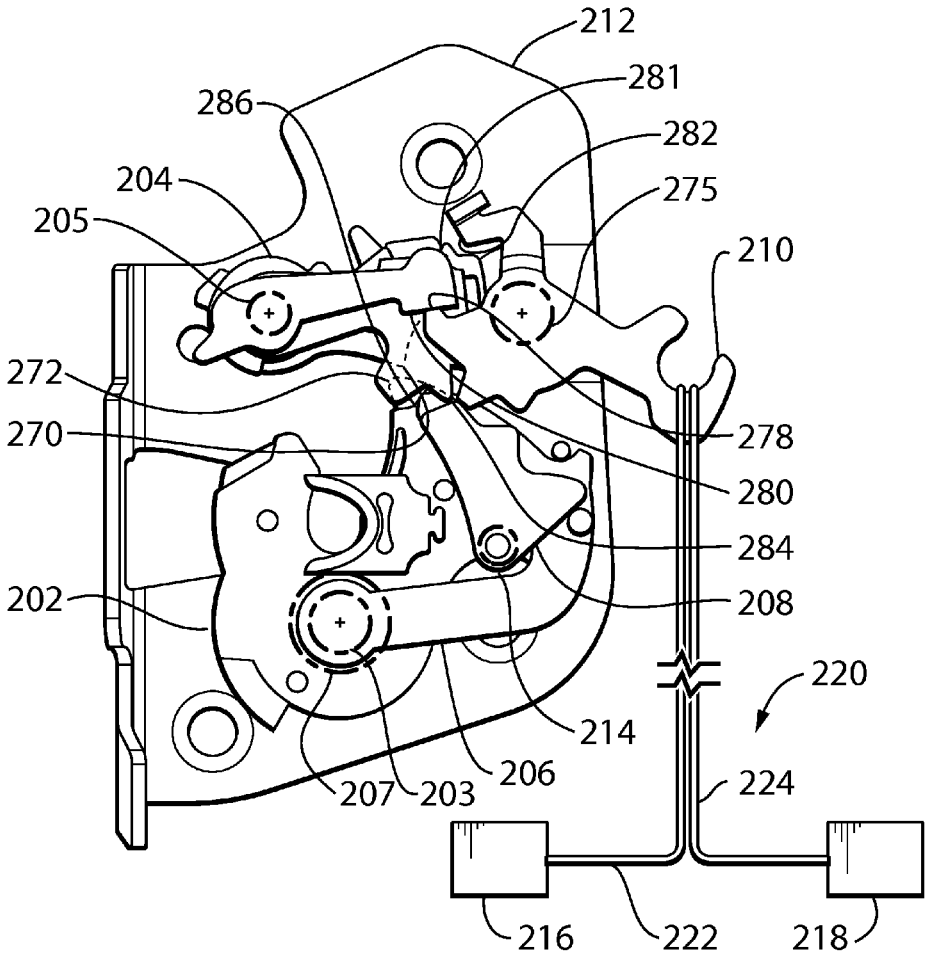
Figure 17:
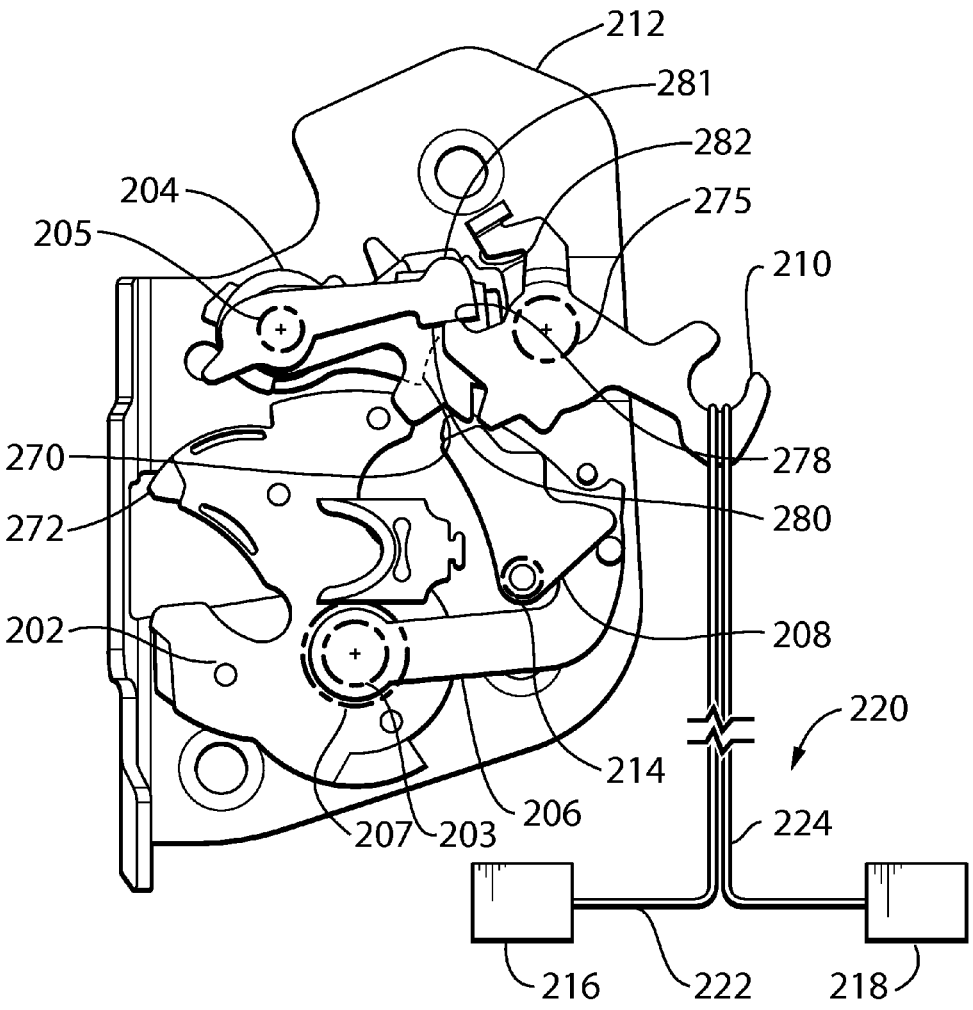

The pawl 204 further includes a first pawl/release lever engagement surface 280 that is engageable with a first pawl/release lever engagement surface 278 when the release lever 210 moves towards the second position (FIG. 16), to assist in moving the pawl 204 to the ratchet release position (FIG. 17). The pawl 204 further includes a second pawl/release lever engagement surface 281 which is engageable with a second pawl/release lever engagement surface 282 on the release lever 210 when the release lever 210 moves to the first position, to assist in ensuring that the pawl 204 reaches the ratchet locking position when the latch 200 is closed, as shown in FIG. 11.

Figure 14:
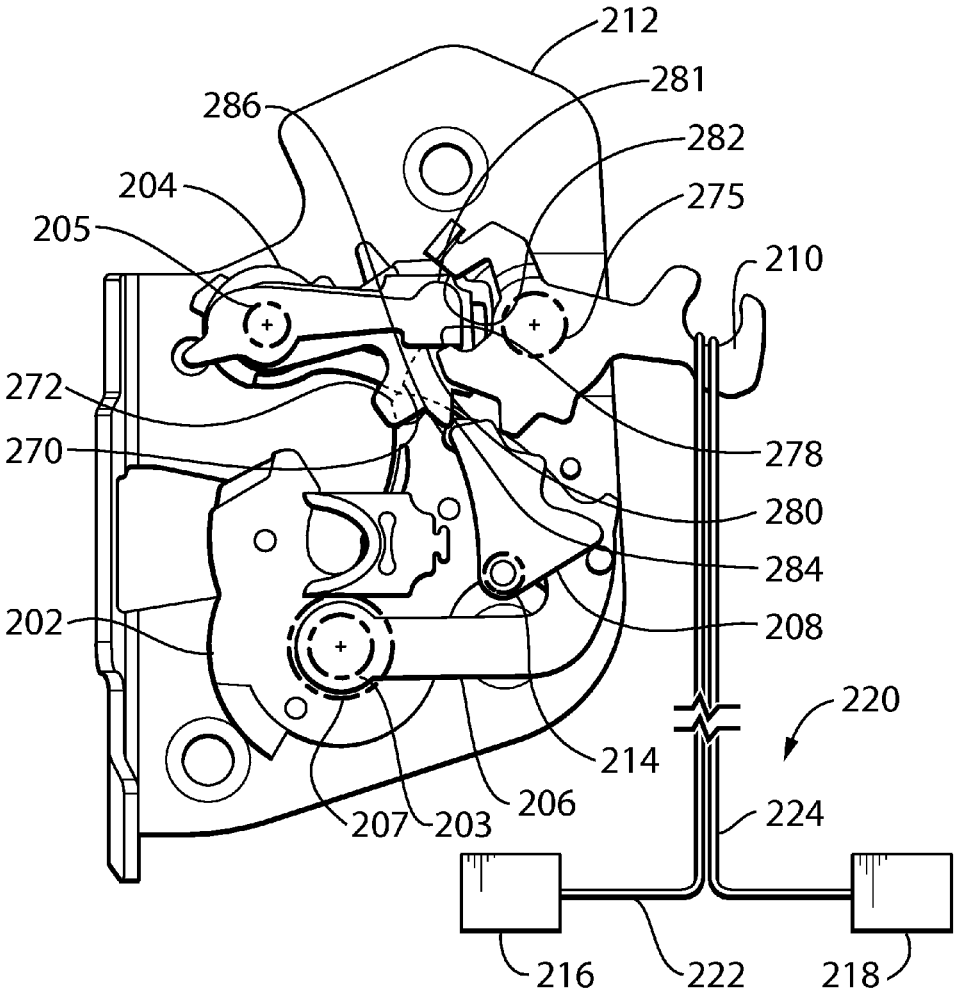
Figure 15:
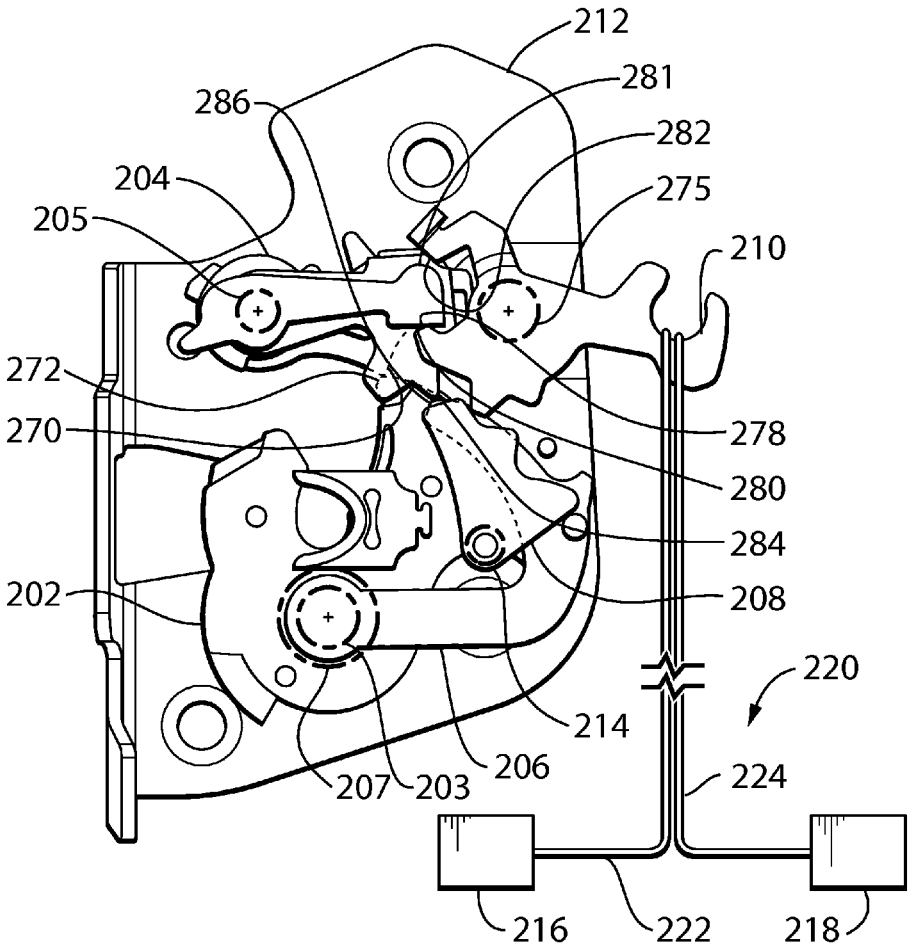

The pawl 204 further includes a pawl/memory lever engagement surface 284 that is engageable with a pawl/memory lever engagement surface 286 when the memory lever 206 moves towards the pawl blocking position, to assist in moving the pawl 204 to the ratchet release position (FIGS. 14-16).

The surfaces 270, 281 and 280 are on a different plane of the pawl 204, than the surface 284. The portion of the pawl 204 in the plane with the surface 284 is shown as transparent so assist in showing the surfaces 270, 281 and 280 underneath and other components that would otherwise be obscured.

The memory lever 206 may be similar to the memory lever 25 (FIG. 1) and is biased towards the pawl blocking position by a memory lever biasing member 207.

The block lever 208 permits an operative connection between the release lever 210 and the memory lever 206. In some embodiments, it would be possible to arrange the release lever 210 in such a way so as to cooperate directly with the memory lever 206 instead of cooperating with the memory lever 206 though the block lever 208. The block lever 208 is movable between a memory blocking position (FIG. 11) and a memory unblocking position (FIG. 16).

The block lever 208 is biased towards the memory blocking position (FIG. 11) by a block lever biasing member 214, which may be, for example, a torsion spring.

The release lever 210 may be similar to the release lever 26 and is biased towards a second position (FIG. 11) by a release lever biasing member 275, which may be, for example, a torsion spring.

Inside and outside door handles shown at 216 and 218 are operatively connected to the release lever 210 by means of a mechanical linkage 220 which may include cables 222 and 224.

In operation, a person pulls a door handle 216 or 218 which moves the release lever 210 to the second position as shown by the progression of movement of the release lever 210 in FIGS. 11-16. Movement of the release lever 210 drives the pawl 204 counterclockwise towards its ratchet release position (FIG. 16) and additionally moves the block lever 208 towards its memory unblocking position (FIG. 16).

Figure 12:
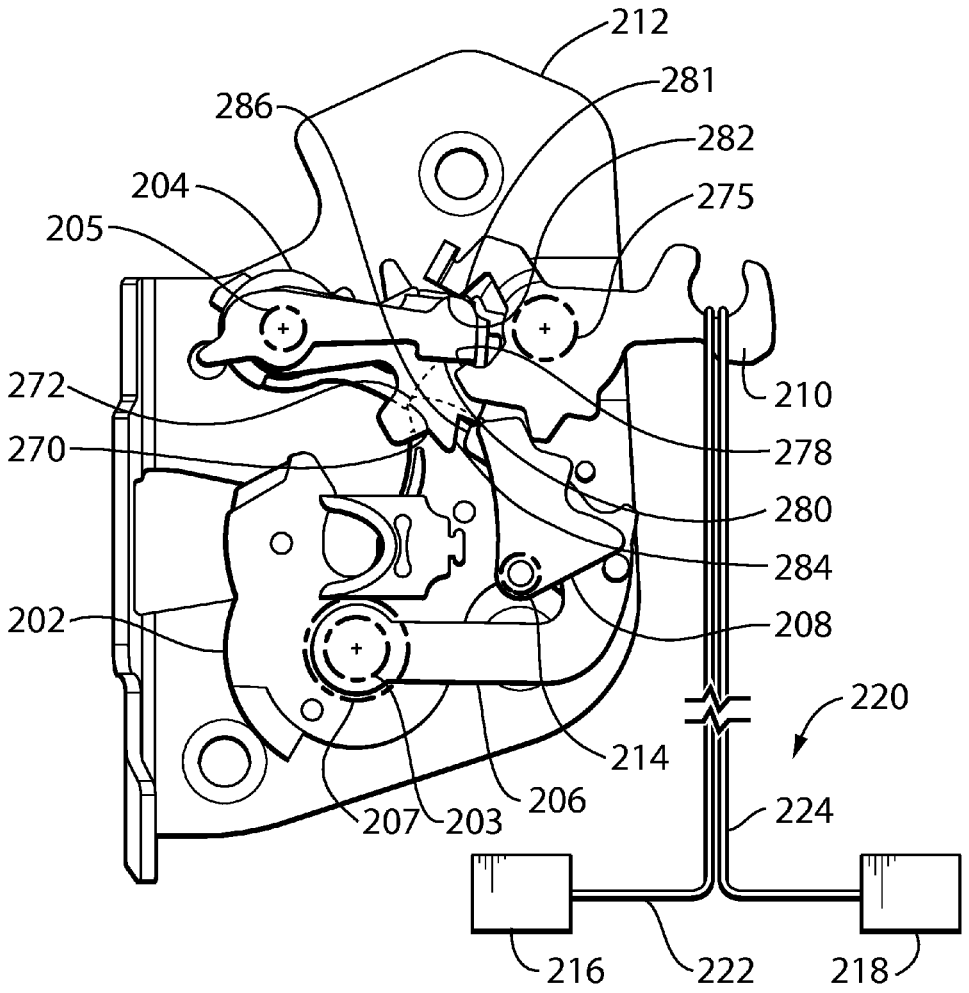
Figure 13:
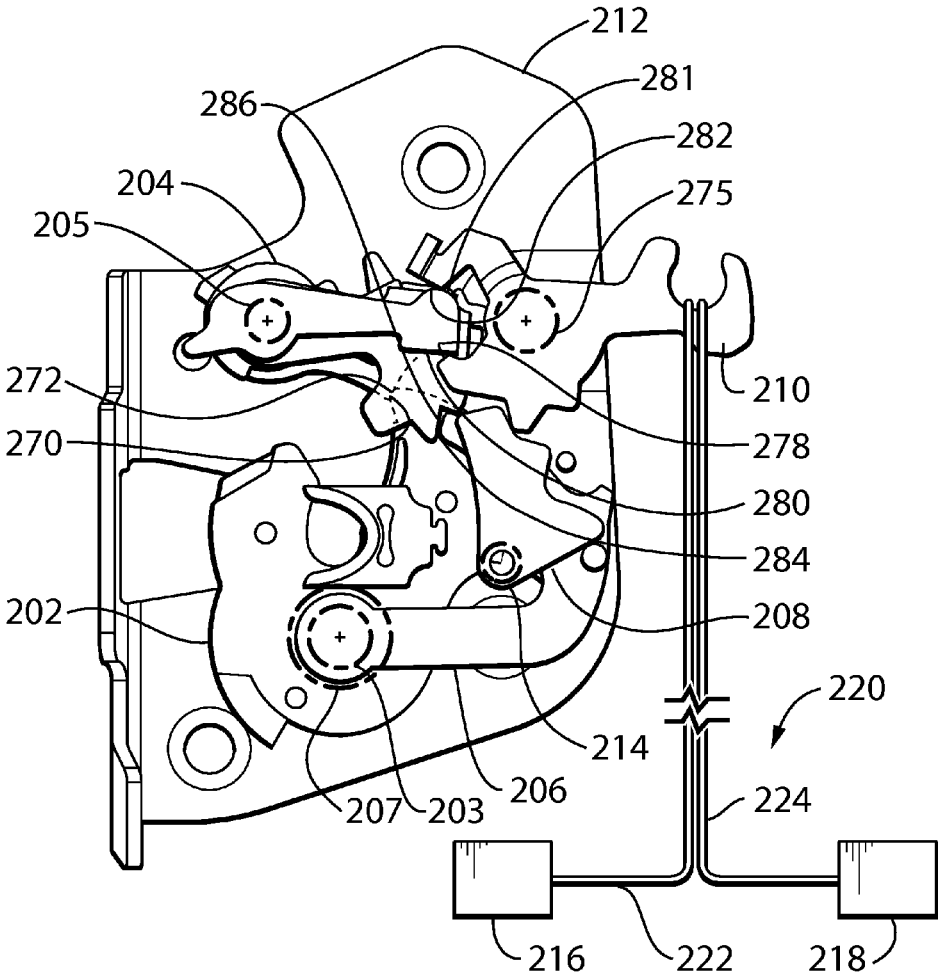

The progression of movement shown in FIGS. 11-17 will now be described. If a person pulls the door handle 216 or 218 the release lever 210 is moved from the first position (FIG. 11) towards the second position (FIG. 16). At some point along its travel, as shown in FIG. 12, the release lever 210 engages the block lever 208 moving it towards its memory unblocking position. At some point along its travel, as shown in FIG. 13, the release lever 210 engages the pawl 204 moving it towards its ratchet release position, and moves the block lever 208 further towards its memory unblocking position. As can be seen in FIG. 13, the block lever 208 has moved sufficiently to bring the memory lever 206 into engagement with the pawl 204. The pawl 204 while having moved by some amount is still engaged with the ratchet 202. As shown in FIG. 14, at some point along the travel of the release member 210, the orientations of the pawl 204 and the memory lever 206 are such that the direction line shown at 226 through which the memory lever 206 engages the pawl 204 exerts a moment on the pawl 204 urging it towards its ratchet release position. As shown in FIG. 15 at some point the release lever 210 stops engagement with the pawl 204, and simply moves the block lever 208 towards its memory unblocking position, which frees the memory lever 206 to move further towards its pawl blocking position, and to urge the pawl 204 farther towards the ratchet release position. In the position shown in FIG. 15, the direction line of engagement between the ratchet 202 and the pawl 204 may also be such that the ratchet 202 exerts a moment on the pawl 204 urging the pawl 204 towards its ratchet release position. However in a situation where the door seal force is low or where for some other reason the ratchet 202 fails to move the pawl 204 sufficiently and where the user holding the door handle 90 or 92 has not held it sufficiently open, the memory lever 206 will move the pawl 204 to the ratchet release position and as the memory itself to the pawl blocking position in the process.

In FIG. 16 the memory lever 206 reaches the pawl blocking position, and holds the pawl 204 in the ratchet release position, so that the pawl 204 will not interfere with the opening of the ratchet 202. Once the pawl 204 is no longer engaged with the ratchet 202, the ratchet 202 is free to move to its open position (FIG. 17).

While the above description constitutes a plurality of embodiments of the present invention, it will be appreciated that the present invention is susceptible to further modification and change without departing from the fair meaning of the accompanying claims.

What is claimed is:

1. A vehicle latch, comprising:

a primary ratchet movable between an open position wherein the primary ratchet is positioned to receive a striker and a closed position wherein the primary ratchet is positioned to retain the striker, wherein the primary ratchet is biased towards the open position by a primary ratchet biasing member;

a primary pawl movable between a ratchet locking position wherein the primary pawl is positioned to hold the primary ratchet in the closed position and a ratchet release position wherein the primary pawl permits the movement of the primary ratchet out of the closed position, wherein the primary pawl is biased towards the ratchet locking position by a primary pawl biasing member;

a memory lever movable between a pawl blocking position in which the memory lever prevents movement of the primary pawl to the ratchet locking position and a pawl unblocking position wherein the memory lever permits movement of the primary pawl to the ratchet locking position, wherein the memory lever is biased towards the pawl blocking position by a memory lever biasing member; and a release lever movable between a first position in which the release lever prevents movement of the memory lever to the pawl blocking position and a second position in which the release lever permits movement of the memory lever to the pawl blocking position and permits movement of the primary pawl to the ratchet release position, wherein the release lever is biased towards the first position by a release lever biasing member, wherein the release lever is operatively connectable to at least one of an inside door handle and an outside door handle for movement to the second position, wherein in an event in which the release lever is moved to the second position and the primary ratchet is restrained from movement to the open position, movement of the memory lever to the pawl blocking position drives the primary pawl to the ratchet release position.

2. A vehicle latch as claimed in claim 1 including an auxiliary ratchet operatively connected to the primary pawl, the auxiliary ratchet being movable between a pawl enabling position in which the auxiliary ratchet permits movement of the primary pawl to the ratchet locking position and a pawl disabling position in which the auxiliary ratchet positions the primary pawl in the ratchet release position, wherein the auxiliary ratchet is biased towards the pawl disabling position by an auxiliary ratchet biasing member; and an auxiliary pawl movable between an auxiliary ratchet locking position in which the auxiliary pawl is positioned to hold the auxiliary ratchet in the pawl enabling position and an auxiliary ratchet release position in which the auxiliary pawl permits the movement of the auxiliary ratchet to the pawl disabling position, wherein the auxiliary pawl is biased towards the auxiliary ratchet locking position by an auxiliary pawl biasing member.

3. A vehicle latch as claimed in claim 2, wherein the primary pawl is pivotally mounted to the auxiliary ratchet.

4. A vehicle latch as claimed in claim 3, wherein the auxiliary ratchet is pivotable about an auxiliary ratchet axis, and wherein the primary pawl is pivotally mounted to the auxiliary ratchet about a primary pawl axis, wherein the primary pawl axis is offset from the auxiliary ratchet axis.

5. A vehicle latch as claimed in claim 4, wherein the memory lever is shaped to urge the primary pawl along a direction line that passes through the primary pawl axis and which generates a moment on the auxiliary ratchet which drives the auxiliary ratchet towards the pawl disabling position.

6. A vehicle latch as claimed in claim 2, further comprising a drive mechanism to drive the auxiliary ratchet to the pawl enabling position after a selected period of time.

7. A vehicle latch as claimed in claim 2, further comprising a drive mechanism and a controller programmed to operate the drive mechanism to drive the auxiliary ratchet to the pawl enabling position after a selected period of time regardless of the position of the primary ratchet and regardless of the position of the release lever.

8. A vehicle latch as claimed in claim 7, wherein the drive mechanism includes a motor.

9. A vehicle latch as claimed in claim 7, wherein the primary ratchet is movable from the open position to the closed position when the auxiliary ratchet is in the pawl enabling position.

10. A vehicle latch as claimed in claim 7, wherein movement of the primary ratchet to the closed position permits the primary pawl to move to the ratchet locking position.

11. A vehicle latch as claimed in claim 1, wherein the memory lever is shaped to urge the primary pawl along a direction line that generates a moment on the primary pawl which drives the primary pawl to the ratchet release position.

12. A vehicle latch as claimed in claim 1, wherein the release lever is directly engageable with the primary pawl to move the primary pawl at least part of the way to the ratchet release position.

13. The vehicle latch as claimed in claim 1 including an auxiliary ratchet pivotally movable between a pawl enabling position in which the auxiliary ratchet permits movement of the primary pawl to the ratchet locking position and a pawl disabling position in which the auxiliary ratchet positions the primary pawl in the ratchet release position; and an auxiliary pawl pivotally movable between an auxiliary ratchet locking position in which the auxiliary pawl engages and holds the auxiliary ratchet in the pawl enabling position and an auxiliary ratchet release position in which the auxiliary pawl disengages the auxiliary ratchet and permits movement of the auxiliary ratchet to the pawl disabling position.

14. The vehicle latch as claimed in claim 13, wherein the auxiliary ratchet is biased toward the pawl disabling position by an auxiliary ratchet biasing member and the auxiliary pawl is biased toward the auxiliary ratchet locking position by an auxiliary pawl biasing member.

15. The vehicle latch as claimed in claim 14 wherein the auxiliary ratchet biasing member is a fifth spring biasing the auxiliary ratchet toward the pawl disabling position and the auxiliary pawl biasing member is a sixth spring biasing the auxiliary pawl toward the auxiliary ratchet locking position.

16. A vehicle latch, comprising:

a primary ratchet pivotally moveable between an open position in which the primary ratchet receives or releases a striker and a closed position in which the primary ratchet retains the striker;

a primary pawl pivotally moveable between a ratchet locking position in which the primary pawl engages and maintains the primary ratchet in the closed position and a ratchet release position in which the primary pawl disengages the primary ratchet and permits movement of the primary ratchet to the open position;

a memory lever pivotally movable between a pawl blocking position in which the memory lever engages the primary pawl and prevents the primary pawl from moving to the ratchet locking position and a pawl unblocking position in which the memory lever disengages the primary pawl and permits movement of the primary pawl to the ratchet locking position; and a release lever movable between a first position in which the release lever disengages the memory lever and permits movement of the memory lever to the pawl blocking position and a second position in which the release lever engages the memory lever and prevents the memory lever from moving to the pawl blocking position.

17. The vehicle latch as claimed in claim 16 including an operative connection between at least one of the door handles and the primary pawl for moving the primary pawl to the ratchet release position upon actuation of the door handle.

18. The vehicle latch as claimed in claim 16, wherein the primary ratchet is biased toward the open position, the primary pawl is biased toward the ratchet locking position, the memory lever is biased toward the pawl blocking position, and the release lever is biased toward the second position.

19. The vehicle latch as claimed in claim 18, wherein a primary ratchet biasing member biases the primary ratchet toward the open position, a primary pawl biasing member biases the primary pawl toward the ratchet locking position, a memory lever biasing member biases the memory lever toward the pawl blocking position, a release lever biasing member biases the release lever toward the second position, and the biasing member are torsion springs.

20. A vehicle latch, comprising:

a primary ratchet movable between an open position wherein the primary ratchet is positioned to receive a striker and a closed position;

a primary pawl movable between a ratchet locking position and a ratchet release position;

a memory lever movable between a pawl blocking position and a pawl unblocking position;

a release lever movable between a first position and a second position;

an auxiliary ratchet pivotally movable between a pawl enabling position and a pawl disabling position; and an auxiliary pawl pivotally movable between an auxiliary ratchet locking position and an auxiliary ratchet release position;

wherein movement of the release lever to the second position drives the auxiliary pawl to the auxiliary ratchet release position, driving the auxiliary pawl to the auxiliary pawl to the auxiliary ratchet release position permits movement of the auxiliary ratchet to the pawl disabling position, and movement of the auxiliary ratchet to the pawl disabling position moves the primary pawl to the ratchet release position; and wherein movement of the release lever to the second position permits movement of the memory lever to the pawl blocking position, movement of the memory lever to the pawl blocking position forces the primary pawl toward the auxiliary ratchet and drives the auxiliary ratchet toward the pawl disabling position, and movement of the auxiliary ratchet to the pawl disabling position moves the primary pawl away from the primary ratchet and allows the memory lever to rotate to the pawl blocking position.

* * * * *